US006945565B2

(12) United States Patent
Fabel

(10) Patent No.: US 6,945,565 B2
(45) Date of Patent: Sep. 20, 2005

(54) POST CARD WITH FOLDABLE FLAP ON MULTI-LABEL MAILING FORM FOR NON-IMPACT PRINTER

(75) Inventor: Warren M. Fabel, Boca Raton, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 10/378,163

(22) Filed: Feb. 28, 2003

(65) Prior Publication Data

US 2003/0234534 A1 Dec. 25, 2003

Related U.S. Application Data

(60) Provisional application No. 60/361,379, filed on Mar. 1, 2002.

(51) Int. Cl.[7] ..... B42D 15/00

(52) U.S. Cl. ..... 283/105; 283/67; 283/79; 283/81; 283/101; 40/630; 40/638; 229/70; 229/300

(58) Field of Search ..... 283/67, 79, 81, 283/101, 61, 62, 98, 106; 229/70, 300, 92, 92.1, 92.8; 40/630, 638

(56) References Cited

U.S. PATENT DOCUMENTS 5,165,726 A * 11/1992 Talbott ..... 283/81
5,476,420 A * 12/1995 Manning ..... 462/6
5,664,725 A * 9/1997 Walz ..... 229/92
5,704,650 A * 1/1998 Laurash et al. ..... 283/81
5,836,622 A * 11/1998 Fabel ..... 283/62
5,887,904 A * 3/1999 Petkovsek ..... 283/61
6,003,902 A * 12/1999 Petkovsek ..... 283/61
6,089,613 A * 7/2000 Petkovsek ..... 283/79
6,136,129 A * 10/2000 Petkovsek ..... 156/247
6,179,202 B1 * 1/2001 Alexander et al. ..... 229/92.8
6,203,068 B1 * 3/2001 Petkovsek ..... 283/79
6,217,078 B1 * 4/2001 Roth et al. ..... 283/81
6,257,624 B1 * 7/2001 Fabel ..... 283/62
6,361,078 B1 * 3/2002 Chess ..... 283/81
6,371,521 B1 * 4/2002 Petkovsek ..... 283/67
6,388,764 B2 * 5/2002 Petkovsek ..... 358/1.18
6,402,022 B1 * 6/2002 Fabel ..... 229/303
6,409,075 B1 * 6/2002 Mehta et al. ..... 229/92.1
6,510,980 B2 * 1/2003 Halbrook et al. ..... 229/92.1
6,769,718 B1 * 8/2004 Warther et al. ..... 283/61
2004/0066032 A1 * 4/2004 Fabel et al. ..... 283/61
2004/0130141 A1 * 7/2004 Fabel et al. ..... 283/62

* cited by examiner

*Primary Examiner*—Derris H. Banks
*Assistant Examiner*—Mark Henderson
(74) *Attorney, Agent, or Firm*—Ted W. Whitlock; Jon A. Gibbons; Fleit, Kain, Gibbons, Gutman, Bongini & Bianco P.L.

(57) ABSTRACT

A form assembly formed by front and back plies for creating a postcard having printing on both faces from a single pass through a non-impact printing device.

7 Claims, 4 Drawing Sheets

POST CARD WITH FOLDABLE FLAP ON MULTI-LABEL MAILING FORM FOR NON-IMPACT PRINTER

This application claims the benefit of Provisional Application 60/361,379, filed Mar. 1, 2002.

BACKGROUND OF THE INVENTION

U.S. Pat. Nos. 5,836,622 and 6,257,624, which are hereby incorporated by reference, teach the ability to print a duplex form with a single pass through a simplex non-impact printer. This allows the user to produce a duplex Postcard without the need for pre-printing. However, these previous patents do not provide for printing of three post cards from a single form.

Other forms that are commercially available provide three postcards on a standard paper size and are printable on the installed base of non-impact printers for purposes of economy and throughput. These products are known in the industry as "3-up" forms. However, these commercially available 3-up products require pre-printing or processing on a duplex printer.

What is needed is a multiple transaction Postal form, utilizing the least amount of materials, which will process on the installed base of non-impact printers, and which does not require preprinting in order to provide variable printed information on the front and back faces of the form.

SUMMARY OF THE INVENTION

The subject invention concerns a more efficient mailing form comprising a post card or other printable document wherein addresses or other variable information can be printed on both front and back faces of the document by a single pass through a simplex printer. The subject form assembly comprises a folding flap, printable on the front face of the assembly and is provided for printing of variable information such as the return address. The folding flap is preferably approximately ⅓ the total height of the post card, therefore saving area on the form assembly and allowing up to three post cards of size and thickness acceptable for United States Postal Service (USPS) specifications to be provided on a single legal size (8.5" by 14") sheet: up to two post cards of USPS-acceptable size and thickness on a single A4 sheet, or one post card of USPS-acceptable size and thickness on a single 8.5" times 5.5" sheet, which will advantageously pass through an envelope feeder of a conventional home or home-office non-impact printer.

DETAILED DESCRIPTION OF THE INVENTION

Figure 1:
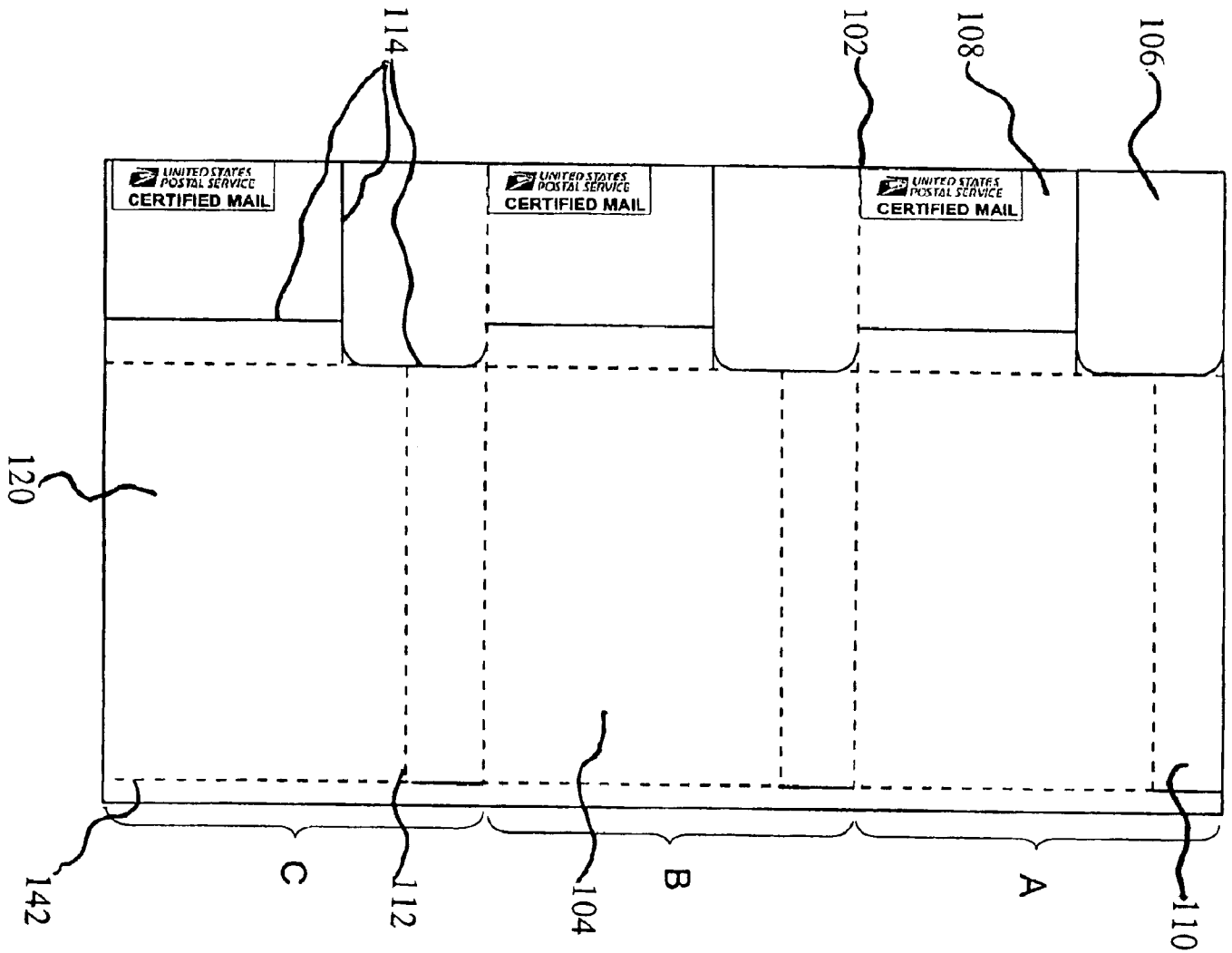
FIG. 1 is a plan view of the front (outer) face of the top ply of a 3-up embodiment of a form assembly according to one embodiment of the invention.

The subject invention comprises a two-ply form. FIG. 1 is a plan view of the front (outer) face of the front ply 120 of a 3-up embodiment of a form assembly according to one embodiment of the invention. The first or front ply 120 is die-cut 102 or perforated, which form tear-lines for providing a plurality of sections. In this example, three identical sections are denoted A, B, and C. It important to note that the number of sections is exemplary only and one or more sections have been shown to be used advantageously with the present invention. Each section has a post card forms 104 and removable labels 106 and 108 typically formed by die-cuts 114 in the front ply 120. The post card form 104 includes a foldable flap 110, which has a perforated fold line 112. The front ply 120 has an inner back face 200. The postcard optionally includes one or more side tabs 142 which are used to attach the post card to an item being mailed.

Figure 2:
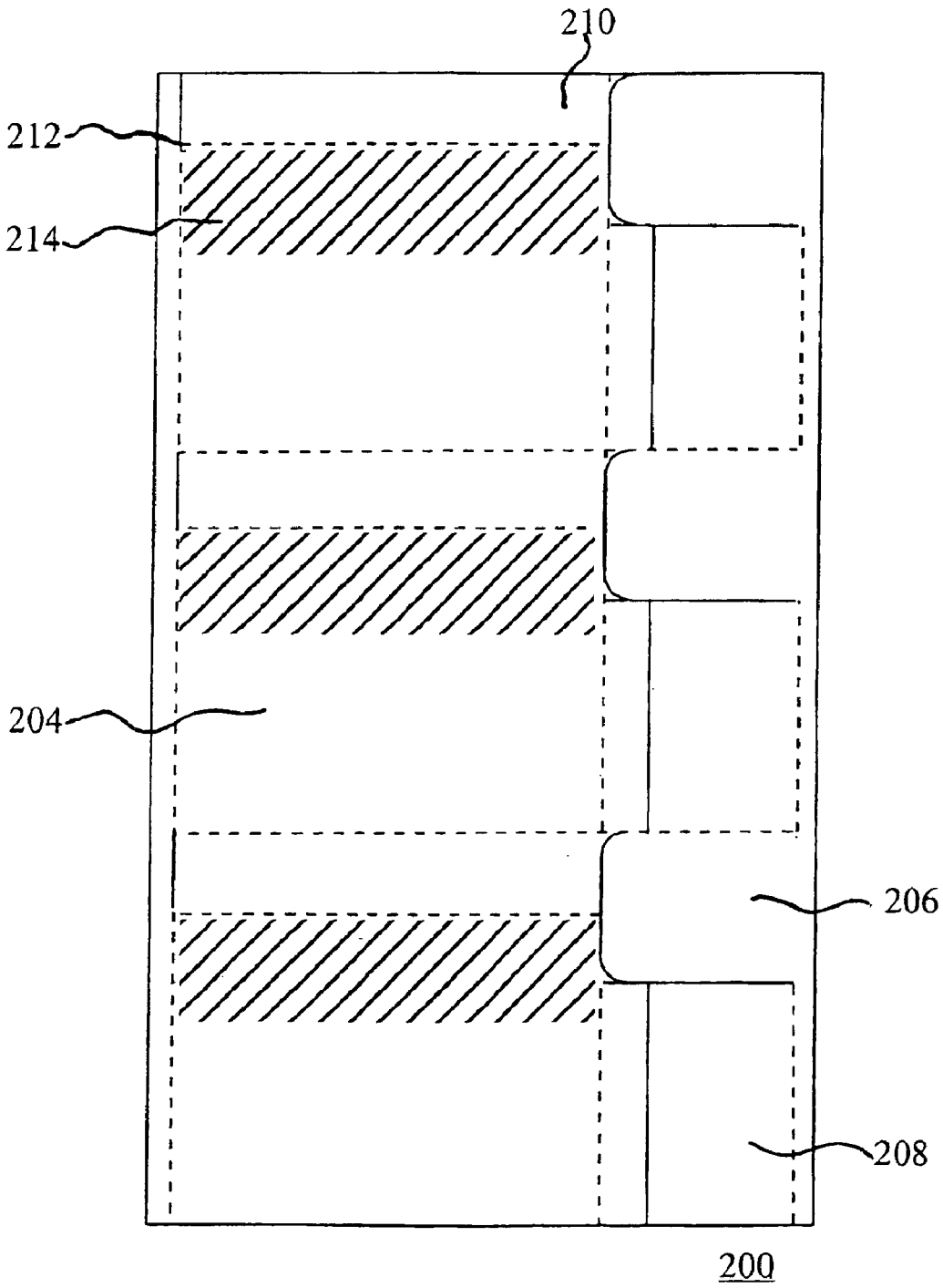
FIG. 2 is a plan view of the back (inner) face of the top ply of a 3-up embodiment of a form assembly according to one embodiment of the invention.

Turning now to FIG. 2, shown is a plan view of the back (inner) face 200 of the top ply of a 3-up embodiment of a form assembly according to one embodiment of the invention. Numbering throughout the figures has been shown to correspond to the front face of the front ply 120 with only the preceding digit changing e.g. 2. For example, the inner face of the post card 204, removable labels 206 and 208, foldable flap 210 and fold line 212 are shown. The back face 200 has adhesive material patternly disposed thereon over substantially the entire surface of the inner face (not shown), except in the substantially rectangular shaded areas 214 as shown in FIG. 2 which is adhesive-free. This adhesive free area 214 forms adjacent the fold line 212 on the back (inner) face 200 of post card 204.

Figure 3:
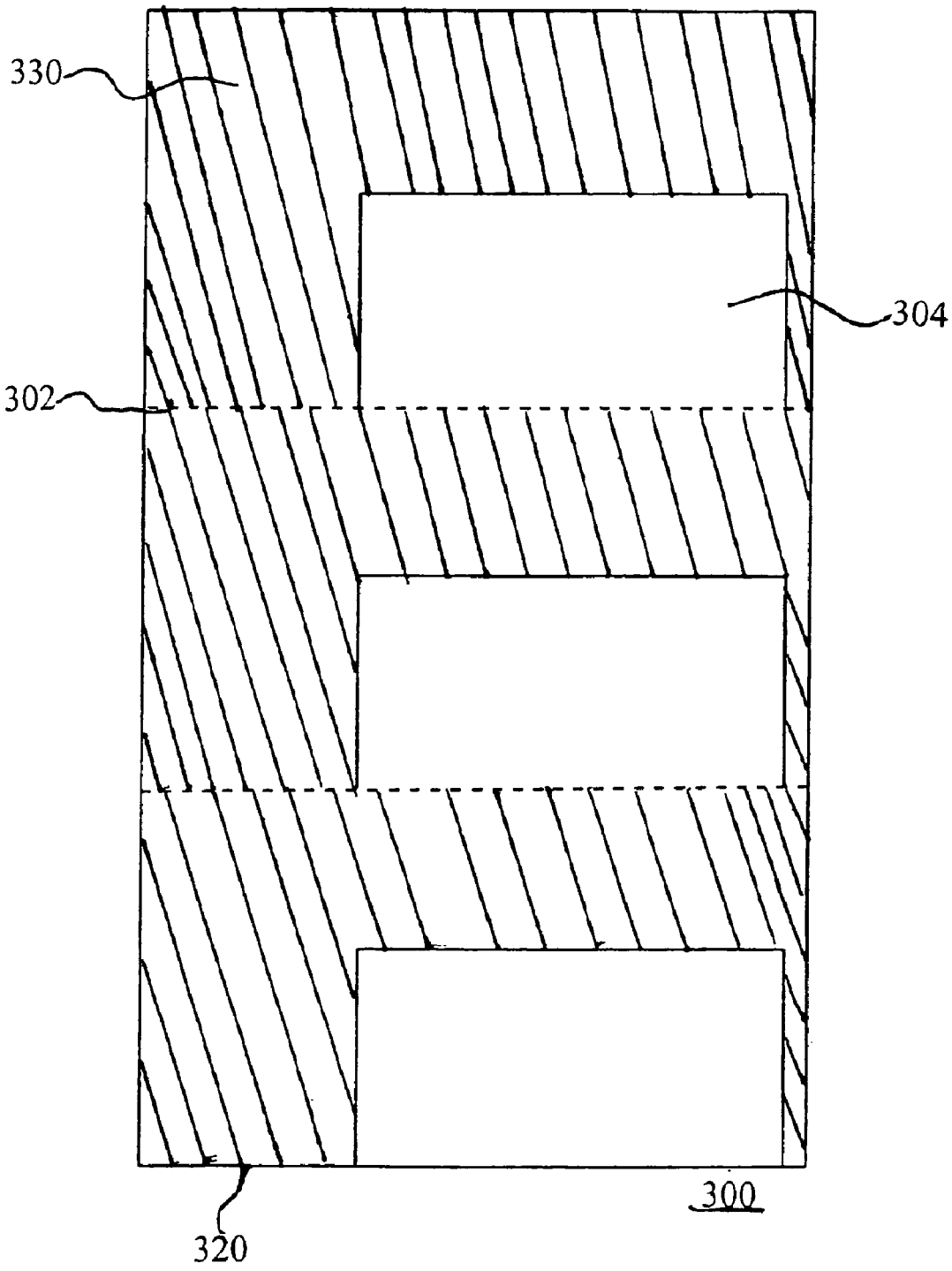
FIG. 3 is a plan view of the inner face of the back ply of a 3-up embodiment of a form assembly according to one embodiment of the invention.

Turning now to FIG. 3, shown is a plan view of the inner face 300 of the back ply 320 of a 3-up embodiment of a form assembly with three identical sections separated by die cuts 302, according to one embodiment of the invention. The second or backing ply 320 has a first inner face 300 which meets the back face 200 of the front ply 120. The backing ply 320 has adhesive release material disposed thereon substantially as shown as shaded area 330 in FIG. 3. Note the back ply area 304 is used in conjunction with the front ply 120 to form a portion of the post card 104.

Figure 4:
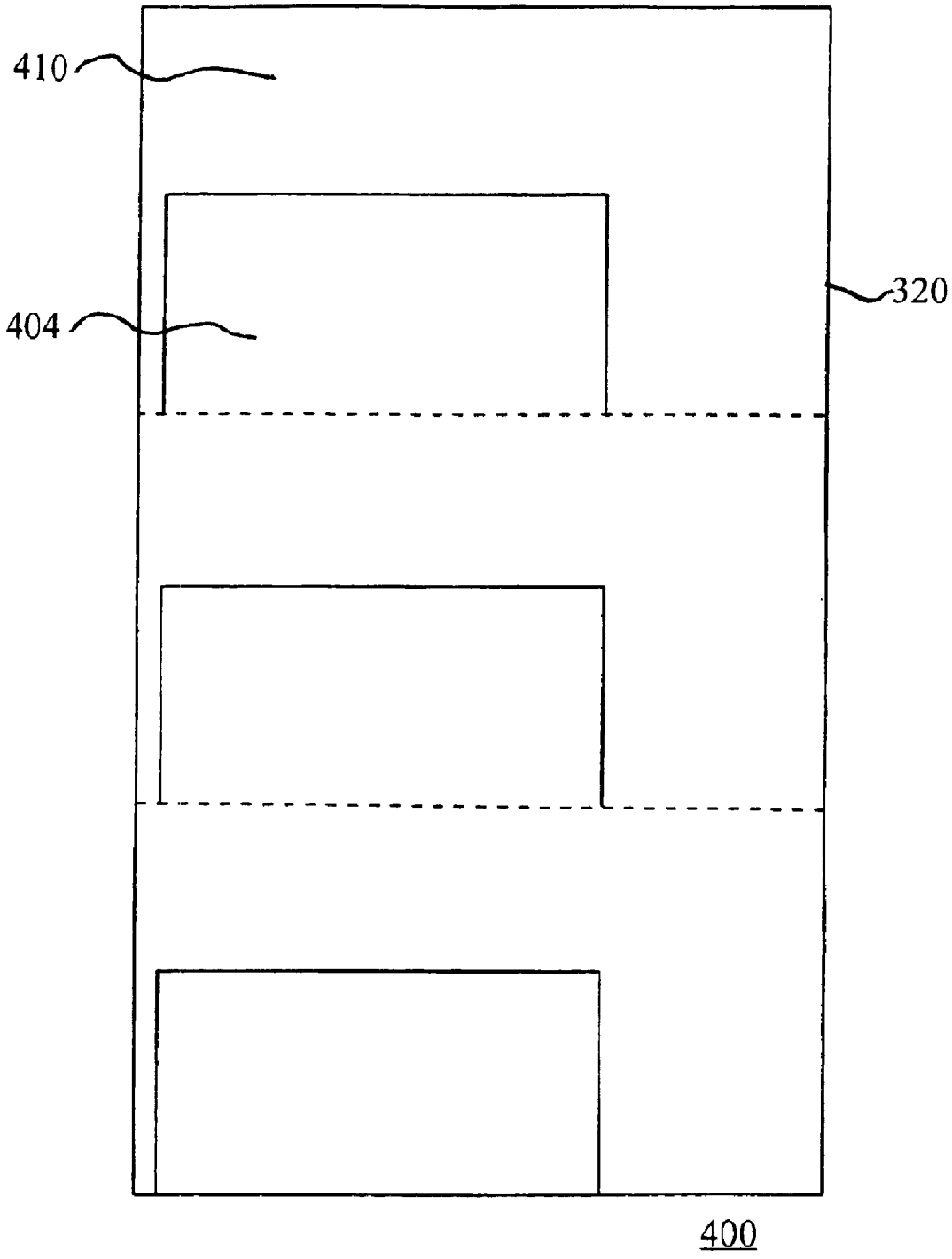
FIG. 4 is a plan view of the outer face of the back ply of a 3-up embodiment of a form assembly according to one embodiment of the invention.

Turning now to FIG. 4, shown is a plan view of the back (outer) face 400 of the back ply 320 of a 3-up embodiment of a form assembly according to one embodiment of the invention. The back face 400 of the backing ply 320, shown in FIG. 4 can have patterned coloring or shading as desired. A back area 404 forms the back face 400 of the post card 104. This back area 404 of the post card 104 is typically where the addressee (i.e. sender or "return to") information is placed on a United Stated Postal Form 3811. A backing strip 410 on the back ply 320 is preferably about twice the height of the fold-over flap 110 so that when the flap is folded, the postcard is uniform in thickness with no possibility of an address label being sheared off in postal processing. In one embodiment, the back strip 410 is initially attached with glue stripes to the top ply 120 to make the back strip 410 portion of the ply 320 removable from the front ply 120. This "striping" disposition of the adhesive or glue allows maximum contact of the folded flap to non-silicon areas to produce a relatively permanent bond, while making the resulting bond more flexible and to allow any trapped air to escape when the plies are pressed together.

Additionally, processing steps are reduced to a minimum. After the multiple form is separated into individual transactions at the tear lines, the form is curled to pop the post card from the backing, and then folded and affixed to the back, outer face of the card to provide an address area on that face.

Generally, the invention has been described in its preferred form or embodiment with some degree of particularity, it is to be understood that this description has been given only by way of example and that numerous changes in the details of construction, fabrication and use, including the combination and arrangement of parts, may be made without departing from the spirit and scope of the invention.

What is claimed is:

1. A unitary mailing form having discrete sections for printing an image on one side thereon by a non-impact printer, said form comprising:

a front sheet formed from at least a first ply to define a first side of a post card and a folding flap for folding over a perforated fold line, the perforated fold line dividing the first side of the post card and the folding flap, the front sheet having at least one of die-cuts and perforations defining a tear line to form discrete sections on which a variable image is printed on a front face of the front sheet including areas on both sides of the fold line, a back face of the front sheet having adhesive material patternly disposed thereon except in a first portion defined by at least a substantially rectangular area forming an edge of an inner surface of the post card substantially adjacent to the fold line for subsequently receiving the folding flap thereon;

a back sheet formed from at least a second ply having at least one of die-cuts and perforations substantially conforming to at least some of the die-cuts and perforations of the front sheet, the back sheet having a front face on which adhesive release material is patternly disposed thereon except in a first area, and a back face on which instructional information can be printed, the front face of the back sheet being attached to the back face of the front sheet so as to form a multi-ply post card with at least one ply of front sheet and at least one ply of the back sheet and a foldable edge defined by the perforated fold line;

wherein the post card is formed to have a substantially uniform thickness by the folding flap being folded and fastened to the first portion of the back face of the front sheet.

2. The mailing form of claim 1, wherein each discrete section is connected to at least one other discrete section.

3. The mailing form of claim 1, wherein the image includes mailing indicia and addressee information printed on a single discrete section.

4. The mailing form of claim 1, wherein the discrete sections on both sides of the fold line include an area for printing as part of the variable image on the front surface of the front sheet, addressee information which is subsequently folded over to the second side of the post card.

5. The mailing form of claim 1, wherein the mailing form is adapted for providing three post cards on a single legal size sheet.

6. An assembly adapted to being folded to form a folded document with images on both sides thereof, following a single pass of the assembly through an image forming device which places an image only on one side of the unfolded assembly, the assembly comprising:

a front sheet defining a front face of at least one post card and a folding flap for folding over a fold line, the front face with an image receiving front surface including areas on both sides of the fold line, a back face with an adhesive coated surface disposed thereon except in first portion defined by at least a substantially rectangular area forming an edge of an inner surface of the post card substantially adjacent to the fold line for subsequently receiving the folding flap thereon;

a back sheet having an outward facing surface, an interior surface being affixed to the adhesive coated surface of the front sheet such that a permanent bond is formed outside of the substantially rectangular area, and a first area of release material being affixed on the interior surface in a shape substantially in contact with the substantially rectangular area and the folding flap so as to permit the folding flap to be released therefrom;

whereby one of the at least one post card is formed of substantially uniform thickness by removing a portion of the back sheet on the other side of the substantially rectangular area, thereby exposing the adhesive coated surface of the folding flap of the front sheet and leaving a remaining portion of the back sheet adhesively joined to the back face of the front sheet, and folding the front sheet about the fold line so that the exposed adhesive coated surface contacts the first portion of the front sheet.

7. The assembly of claim 6, wherein the portion of the folding flap includes an area for printing as part of the image on the front surface of the front sheet, addressee information which is subsequently folded over to the second side of the post card.

* * * * *